United States Patent [19]

Olsen

[11] 4,312,128

[45] Jan. 26, 1982

[54] USEFUL DEVICE SUCH AS A CUTTING IMPLEMENT FOR SUSPENDING FROM A KEY RING OR THE LIKE

[76] Inventor: Theodore A. Olsen, 26 Hollowbrook Ct. W., Peekskill, N.Y. 10566

[21] Appl. No.: 163,508

[22] Filed: Jun. 27, 1980

[51] Int. Cl.[3] ..... B26B 5/00; B26B 11/00

[52] U.S. Cl. ..... 30/157; 30/339; D3/64; 70/456 R

[58] Field of Search ..... 30/155, 156, 157, 339, 30/123; D3/61, 62, 63, 64; 70/456 R

[56] References Cited

U.S. PATENT DOCUMENTS

| | | | |
|---|---|---|---|
| 1,049,931 | 1/1913 | Smith | 30/157 |
| 1,487,655 | 3/1924 | Hlavacek | 30/156 |
| 1,808,239 | 6/1931 | Logan | 30/157 |
| 2,265,775 | 12/1941 | McNamara | 30/156 |
| 3,641,667 | 2/1972 | Leopoldi | 30/156 X |

*Primary Examiner*—Jimmy C. Peters

[57] ABSTRACT

A useful device, such as a cutting implement, is provided for suspending from a key ring or the like. For example, the cutting implement comprises an elongated blade having a cutting edge along at least one edge. The blade is further comprised of a substantially cylindrical first mounting sleeve through one end of the blade. An elongated sheath is provided which has an enclosure along a portion of the length of the sheath. The enclosure is open along its length. The enclosure engages the blade and contains the cutting edge of the blade when the implement is in the closed position. The sheath further has a substantially cylindrical second mounting sleeve through one end of the sheath. One of the sleeves is removably nested within the other sleeve to provide a securing device for detachably and pivotally connecting the blade and sheath. This type securing device may also be utilized on other useful devices, for securing such devices to a key ring or the like.

16 Claims, 8 Drawing Figures

USEFUL DEVICE SUCH AS A CUTTING IMPLEMENT FOR SUSPENDING FROM A KEY RING OR THE LIKE

RELATED DISCLOSURES

This application is related to Disclosure Document No. 084,243 filed on Sept. 14, 1979 in the U.S. Patent and Trademark Office. The entire Disclosure Document is incorporated herein by reference.

BACKGROUND OF THE INVENTION

1. Field of the Invention

This invention relates to useful devices which may be suspended from a keyring or the like, particularly relates to a cutting implement, and more particularly relates to a universal device for cutting objects, paper, field surgery, shaving, etc. having a cutting edge associated therewith that is fully enclosed and out of view to protect the user, easily openable to expose the cutting edge, can be suspended from a keyring or the like and can be utilized on the keyring in an easy manner.

2. Prior Art

There are numerous prior art cutting implements which can be suspended from a keyring or the like, for example see the following U.S. patents:

U.S. Pat. No. 1,073,581 to Humphrey;
U.S. Pat. No. 1,168,633 to Heywood;
U.S. Pat. No. 2,081,232 to Haas;
U.S. Pat. No. 2,134,973 to Harwell;
U.S. Pat. No. 2,213,292 to Testi;
U.S. Pat. No. 2,265,775 to McNamara;
U.S. Pat. No. 2,647,311 to Apden;
U.S. Pat. No. 3,306,297 to Voorhees et al; and
U.S. Pat. No. 4,027,386 to Spinosa et al.

All of these references relate to cutting devices, in particular small cutting devices suitable for placement in a pocket or on a keyring or the like. Some of these references describe cutting devices having detachable blades.

A review of these references discloses that they all describe a cutting implement having a guard/handle and a blade, wherein the blade is connected to the handle when in use. Various attachment means are utilized to attach the blade to the handle for easy replacement of the blade. Humphrey, for example, describes a cutting device wherein a razor blade may be easily replaced in the guard/handle.

Most of these references describe the concept of a blade fitting within a guard and a blade being rotatably mounted in some manner to the guard. None of the references, however teach or suggest the use of the blade when detached from its guard/handle and the possible prevention of loss of the guard/handle if used in such a manner.

OBJECTS AND SUMMARY OF THE INVENTION

It is an object of the present invention to provide a cutting implement which may be suspended from a keyring or the like, wherein the blade and cutting edge are hidden from view in the closed position.

Another object of the present invention is to provide a cutting implement which may be suspended from the keyring or the like wherein the blade may be easily removed and detached from the sheath and used.

It is a further object of this invention to provide a novel means of securing the blade to the sheath.

Another object of the present invention is to provide a cutting implement that may be easily opened for use to expose the cutting edge mounted therein.

It is still another object of this invention to provide a novel means of suspending a useful article from a keyring or the like.

Other objects of the present invention will become apparent as the disclosure proceeds.

This invention provides, broadly, for a useful device which may be suspended from a keyring or the like. The useful device comprises:

(a) a first elongated member having a substantially cylindrical first mounting sleeve through the first member;

(b) a second elongated member having an engaging means along a portion of the length of the second member for engaging a portion of the edge of the first member when the first and second member are in a locked position, the second member having a substantially cylindrical second mounting sleeve through one end of the first member;

wherein one sleeve can be removably nested within the other sleeve to provide a securing means for detachably and pivotally connecting the first and second member.

The useful members that may be attached to the elongated member are numerous, but in particular the aforementioned device is useful as a cutting implement which may be suspended from a keyring or the like. The cutting implement comprises:

(a) an elongated blade having a cutting edge along at least one edge and a substantially cylindrical first mounting sleeve through one end of the blade;

(b) an elongated sheath means having an enclosure means along a portion of the length of the sheath, open along the length of the enclosure means, for engaging the blade and containing the cutting edge when the implement is in the closed position, the sheath means having a substantially cylindrical second mounting sleeve through one end of the sheath, wherein one sleeve can be removably nested within the other sleeve to provide a securing means for detachably and pivotally connecting the blade and sheath.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE INVENTION

Figure 1:
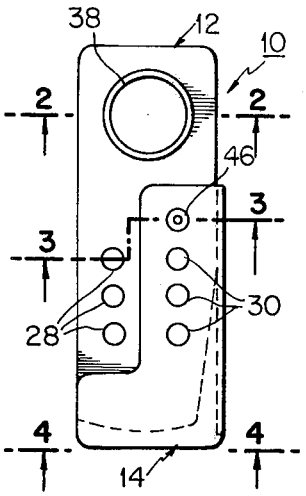
FIG. 1 is a side elevational view of an embodiment of a useful device of this invention, a cutting implement in its closed position.

Referring more particularly to FIGS. 1 through 6, the cutting implement of this invention is generally designated (10). The cutting implement (10) is comprised of an elongated blade (12) and an elongated sheath means (14). The elongated blade (12) and sheath means (14) may be suspended from a keyring (16) or the like. Preferably, for convenience, the cutting implement (10) is about the width, length and thickness of a conventional key, e.g. ¾ inch wide, 2 inches long and from 1/16 to 3/32 of an inch thick, and about the same weight as a conventional key e.g. from about ¼ to ½ oz. Thus the cutting implement (10) can be unobtrusively contained or nested within a plurality of keys on a keyring.

The elongated blade (12) has a cutting edge (18 and 18A) along at least one edge of the blade (12). Referring to FIGS. 5 through 8, the preferred embodiment of this invention has a cutting edge (18) along the length of the blade (12) and another cutting edge (18A) along the width of the blade (12). Such an embodiment of the cutting edge permits the blade (12) to have a plurality of functions. For example, deep cuts may be made when edge (18) and corner (20) are used to cut. This may be used to cut, for example, corrugated boxes, bulk envelopes, mailers, cardboard patterns, etc. The blade (12) may also be used for penetrating cuts. This is accomplished when the sharp corner (20) does the cutting. This permits "pocket cuts" for penetrating cardboard boxes, shrink packs, blister packs, etc. Additionally the blade (12) may be used for shallow cutting. In this case the blade (12) is held in a vertical position and utilizes primarily cutting edge (18A). Preferably cutting edge (18A) is slightly rounded. This configuration permits shallow cuts to be made, for example, in newspaper or magazine pages, etc., without substantially damaging the succeeding pages or backing to the page being cut. Edge (18A) and its proper use insure one layer paper cutting. Other embodiments of cutting edges may be utilized with the cutting implement (10) of this invention.

The elongated blade (12) further has a substantially cylindrical first mounting sleeve (22) through one end of the blade (12). In FIGS. 1, 2, 5, 7 and 8 the first mounting sleeve (22) is simply a circular hole through the blade (12). The sleeve (22) is thus the thickness of the blade (12). Preferably the diameter of sleeve (22) is as large as possible to permit maximum flexibility of the blade (12) while in use on the keyring (16) and also to provide easy placement and swiveling on the sheath means (14).

In the preferred embodiment of the invention, depicted in FIGS. 1 through 6 the diameter of the mounting sleeve (22) is of a diameter which permits the edges of the sleeve (22) to frictionally engage the thumb (24) when in use. This permits easier gripping of the blade (12).

Figure 7:
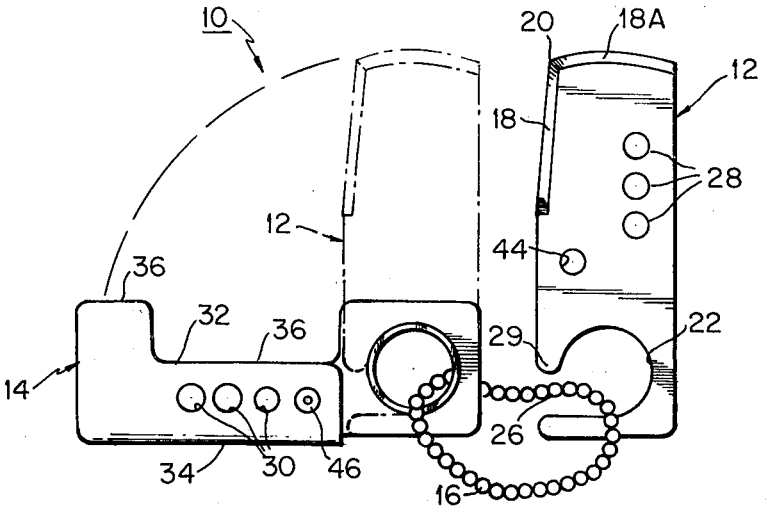
FIG. 7 is a side elevational view of another embodiment of the cutting implement of this invention in its open position attached to a keyring or the like, wherein the blade has been removed and detached from the sheath.
Figure 8:
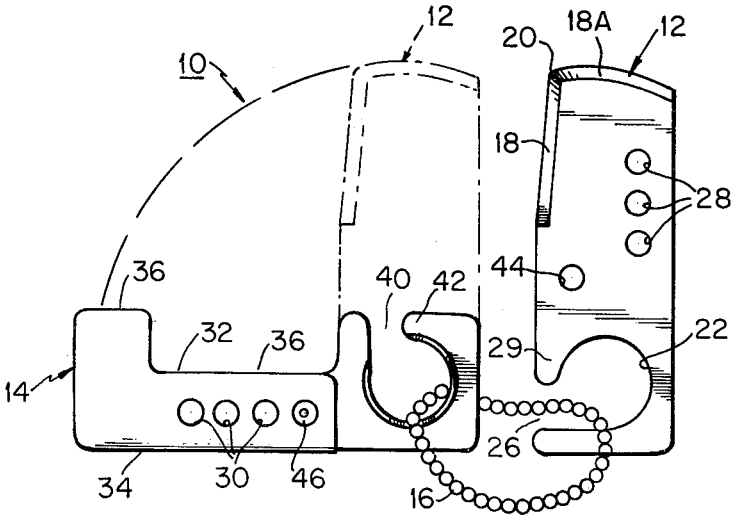
FIG. 8 is a side elevational view of still another embodiment of the cutting implement of this invention in its open position attached to a keyring of the like, wherein the blade has been removed and detached from its sheath.

In the embodiments depicted in FIGS. 7 and 8, the blade (12) has an opening (26) which runs from an edge (29) of the blade (12) to the inside of the first mounting sleeve (22). Thus one using the blade (12), after it is removed from the sheath means (14) may also remove it from the keyring (16). This permits the use of the blade (12) without the encumberance of the keyring (16) and the keys attached thereto. In FIG. 7, the sheath means (14) remains on the keyring (16), while in FIG. 8 the sheath means (14) may also be removed (described below).

Preferably, as shown in FIGS. 1, 5, 6, 7 and 8, the blade (12) has a plurality of gripping holes (28) along the length of the blade (12). These holes (28) permit the person utilizing the cutting implement (10) to grip the blade (12), for example between a thumb and forefinger, on the gripping holes (28). The holes (28) provide a frictional surface for the fingers to grip permitting easier opening of the blade (12). These holes (28) not only provide a gripping surface for the user, but also decrease the weight of the cutting implement (10) and eliminate broken fingernails generally associated with the conventional grooves used in pocket knives. A like plurality of gripping holes (30) run along the length of the sheath means (14).

The cutting implement (10) of this invention is further comprised of the elongated sheath means (14). The sheath means (14) has an enclosure means (32). The enclosure means (32) runs along a portion of the length of the sheath means (14) and is open along the length of the enclosure means (32). The enclosure means (32) engages the blade (12) and contains the cutting edges (18 and 18A) when the implement (10) is in the closed position. As depicted in FIGS. 1 through 8, the enclosure means is a piece of sheet metal or plastic folded along edge (34) and open along edge (36).

Figure 2:
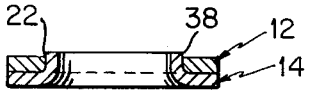
FIG. 2 is a sectional view of the cutting implement of FIG. 1, taken along line 2—2 of FIG. 1.
Figure 3:
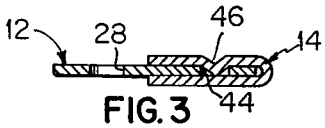
FIG. 3 is a sectional view of the cutting implement of FIG. 1 taken along line 3—3 of FIG. 1.
Figure 4:
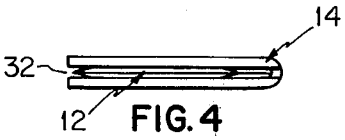
FIG. 4 is a sectional view of the cutting implement of FIG. 1 taken along line 4—4 of FIG. 1.
Figure 5:
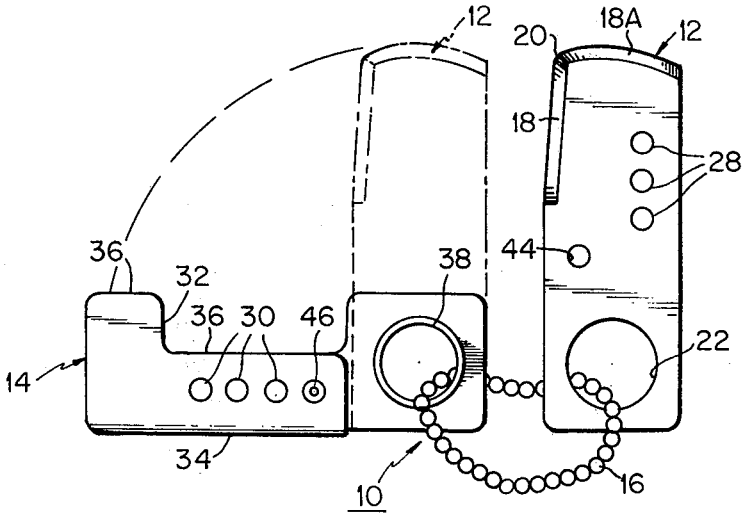
FIG. 5 is a side elevational view of the cutting implement of FIG. 1 in its open position attached to a keyring or the like, wherein the blade has been removed and detached from the sheath.

The sheath means (14) further comprises a substantially cylindrical second mounting sleeve (38) which passes through one end of the sheath (14). As depicted in FIGS. 1 and 2, the second mounting sleeve (38) passes through the sheath means (14) projects somewhat above the sheath means (14) to permit the placement of the first mounting sleeve (22) thereon. Thus one sleeve (38) can be removably nested within the other sleeve (22) to provide a securing means for detachably and pivotally connecting the blade (12) and sheath means (14). It should be noted that the mounting sleeve (38) permits the easy removal of the first mounting sleeve (22) therefrom. It is not necessary that the sheath means (14) be provided with a mounting sleeve (38) that projects above the sheath means (14) to form a shoulder thereon. This may be reversed, for example, the sheath means (14) may have a mounting sleeve which is a hole through the sheath means (14) the blade (12) may have a mounting sleeve which projects from the blade (12) to form a shoulder for placement of the sheath means mounting sleeve thereon. This embodiment is not depicted in the figures.

Referring to FIG. 8, an opening (40) is provided in the sheath means (14) which runs from an edge (42) fo the sheath (14) to the inside of the second mounting sleeve (38). Such an opening (40) provides for the easy removal of the sheath means (14) from the keyring (16) when the cutting implement (10) is in its open position.

When opening (40) is combined with opening (26), as shown in FIG. 8, the opening (26) in the sheath means (14) and the opening (40) in the blade (12) should not overlap each other when the cutting implement (10) is in the closed position. When both openings (26 and 40) are present it is possible to remove both the sheath (14) and blade (12) from the keyring (16) when the cutting implement (10) is in the open position. Such an embodiment permits the easy attachment and removal of the cutting implement (10) from the keyring (16).

In the preferred embodiments depicted, there is at least one engagement hole (44) in the blade (12) and a mating dimple (46) in the enclosure means (32). Thus the dimple (46) engages the hole (44) when the cutting implement (10) is in the closed position. This is depicted more clearly in FIG. 3.

Although the cutting implement depicted in the Figures is primarily designed for use on a keyring or the like it may be used separately. A small ring may be provided to keep the two components i.e. the blade (12) and the sheath means (14), from becoming separated and/or lost when the cutting implement (10) is in the open position.

If the cutting implement (10) depicted in FIGS. 1–6 is to be kept on a keyring (16), when used the blade (12) is pulled from the sheath means (14) with the thumb and forefinger of each hand grasping the gripping holes (28 and 30). The blade (12) is swiveled at a right angle to the sheath means (14) and the blade (12) removed from the second mounting sleeve (38) on the sheath means (14). A reverse procedure is used to close the cutting implement (10). The locking dimple (46) and the hole (44) prevent the blade (12) from accidently separating from the sheath means (14).

Figure 6:
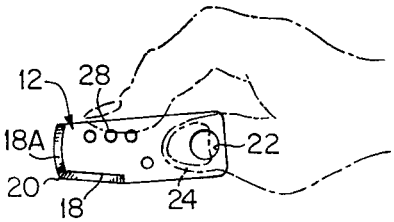
FIG. 6 is a side elevational view of the elongated blade of the cutting implement of FIG. 1 in use.

In use, the sheath means (14), keyring (16), and other keys are kept in the palm of the hand while the thumb and forefinger are used on the blade (12) as depicted in FIG. 6, for cutting.

Another aspect of this invention (of which the cutting implement (10) is only a specific example) provides for a useful device which may be suspended from a keyring or the like. This useful device comprises:

(a) a first elongated member having a substantially cylindrical mounting sleeve through the first member;

(b) a second elongated member having an engaging means along a portion of the length of the second member for engaging a portion of the edge of the first member when the first and second member are in a locked position, the second member having a substantially cylindrical mounting sleeve through one end of the first member;

wherein one sleeve can be removably nested within the other sleeve to provide a securing means for detachably and pivotally connecting the first and second members.

Likewise, such a useful device may have openings (40 and 26) similar to those depicted in FIGS. 7 and 8. In its broad concept a useful device may be attached to the elongated members. For example, the top of a box may be on the first elongated member and the bottom of the box may be on the second elongated member. Such a box may be used to hold pills, change, etc.

Although illustrative embodiments of this invention have been described herein, with reference to the accompanying drawings, it is to be understood that the invention is not limited to these precise embodiments, and that various changes and modifications may be effected without departing from the scope and spirit of the invention.

What is claimed is:

1. A cutting implement comprising:

(a) an elongated blade having a cutting edge along at least one edge and a substantially cylindrical first mounting sleeve through one end of the blade;

(b) an elongated sheath means having an enclosure means along a portion of the length of the sheath open along the length of the enclosure means, for engaging the blade and containing the cutting edge when the implement is in the closed position, the sheath means having a substantially cylindrical second mounting sleeve through one end of the sheath wherein one sleeve is a hole through the blade or sheath means and the other sleeve projects above the blade or sheath means to permit placement of the other sleeve thereon, whereby one sleeve can be removeably nested within the other sleeve to provide a securing means for detachably and pivotally connecting the blade and sheath and a key ring or the like can pass through the sleeves to secure the blade and sheath to the ring.

2. The cutting implement of claim 1, further comprising an opening in the blade from an edge of the blade to the inside of the first mounting sleeve.

3. The cutting implement of claim 1, further comprising an opening in the sheath from an edge of the sheath to the inside of the second mounting sleeve.

4. The cutting implement of claim 3, further comprising an opening in the blade from an edge of the blade to the inside of the first mounting sleeve, wherein the opening of the sheath and the opening in the blade do not overlap each other when the implement is in the closed position.

5. The cutting implement of claim 1, further comprising a plurality of gripping holes in the blade.

6. The cutting implement of claim 5, wherein the holes are along the length of the blade.

7. The cutting implement of claim 1, further comprising a plurality of gripping holes in the sheath.

8. The cutting implement of claim 7, wherein the holes are along the length of the sheath.

9. The cutting implement of claim 6, further comprising a plurality of gripping holes along the length of the sheath.

10. The cutting implement of claim 1, further comprising at least one engagement hole in the blade and a mating dimple in the enclosure means, wherein the dimple engages the hole when the implement is in the closed position.

11. A useful device comprising:

(a) a first elongated member having a substantially cylindrical mounting sleeve through the first member;

(b) a second elongated member having an engaging means along a portion of the length of the second member engaging a portion of the edge of the first member when the first and second member are in a locked position, the second member having a substantially cylindrical second mounting sleeve through one end of the first member, wherein one sleeve is a hole through the first or second member and the other sleeve projects above the first or second member to permit placement of the other sleeve thereon, whereby one sleeve can be removeably nested within the other sleeve to provide securing means for detachably and pivotally connecting the first and second member and a key ring or the like can pass through the sleeve to secure the members to the ring.

12. The useful device of claim 11, further comprising an opening in the first member from an edge of the first member to the inside of the first mounting sleeve.

13. The useful device of claim 12, further comprising an opening in the second member from an edge of the second member to the inside of the second mounting sleeve, wherein the opening in the first member and the opening in the second member do not overlap each other when the first member and second member are in the locked position.

14. A cutting implement comprising:

(a) an elongated blade having a cutting edge along at least one edge and a substantially cylindrical first mounting sleeve through one end of the blade, and an opening in the blade from an edge of the blade to the inside of the first mounting sleeve;

(b) an elongated sheath means having an enclosure means along a portion of the length of the sheath, open along the length of the enclosure means for engaging the blade and containing the cutting edge when the implement is in the closed position, the sheath means having a substantially cylindrical second mounting sleeve through one end of the sheath and an opening in the sheath from an edge of the sheath to the inside of the second mounting sleeve;

wherein the opening of the sheath and the opening the the blade do not overlap each other when the implement is in the closed position and one sleeve can be removeably nested within the other sleeve to provide a securing means for detachably and pivotally connecting the blade and sheath.

15. A useful device comprising:

(a) a first elongated member having a substantially cylindrical mounting sleeve through the first member and an opening in the first member from an edge of the first member to the inside of the first mounting sleeve;

(b) a second elongated member having an engaging means along a portion of the length of the second member for engaging the portion of the edge of the first member when the first and second member are in a locked position, the second member having a substantially cylindrical second mounting sleeve through one end of the second member and an opening in the second member from an edge of the second member to the inside of the second mounting sleeve;

wherein the opening in the first member and the opening in the second member do not overlap each other when the first member and the second member are in the locked position and one sleeve can be removeably nested within the other sleeve to provide a securing means for detachably and pivotally connecting the first and second member.

16. The cutting implement of claim 1, wherein the blade and mounting sleeve are integrally formed.

* * * * *